US010710077B2

(12) United States Patent
Baroud et al.

(10) Patent No.: US 10,710,077 B2
(45) Date of Patent: Jul. 14, 2020

(54) METHOD FOR HANDLING MICRODROPS WHICH INCLUDE SAMPLES

(71) Applicants: ECOLE POLYTECHNIQUE, Palaiseau (FR); CENTRE NATIONAL DE LA RECHERCHE SCIENTIFIQUE, Paris (FR)

(72) Inventors: Charles Baroud, Paris (FR); Gabriel Amselem, Paris (FR); Sébastien Sart, Bailly (FR); Raphaël Tomasi, Paris (FR)

(73) Assignees: ECOLE POLYTECHNIQUE, Palaiseau (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 365 days.

(21) Appl. No.: 15/519,574

(22) PCT Filed: Oct. 17, 2014

(86) PCT No.: PCT/FR2014/052655
§ 371 (c)(1),
(2) Date: Apr. 17, 2017

(87) PCT Pub. No.: WO2016/059302
PCT Pub. Date: Apr. 21, 2016

(65) Prior Publication Data
US 2017/0252744 A1 Sep. 7, 2017

(51) Int. Cl.
*B01L 3/00* (2006.01)

(52) U.S. Cl.
CPC ... *B01L 3/502784* (2013.01); *B01L 3/502746* (2013.01); *B01L 2200/0642* (2013.01);
(Continued)

(58) Field of Classification Search
CPC ..... B01L 3/502761; B01L 2300/0816; B01L 2400/0424; B01L 2200/0647; B01L 3/50273; B01L 2200/0668; B01L 2400/0427; B01L 2400/0487; B01L 2300/0861; B01L 2300/0864; B01L 2300/0887; B01L 2400/0415; B01L 3/502715; B01L 2200/06; B01L 2300/161; B01L 2300/165; B01L 2400/043; B01L 3/502784; B01L 2200/027; B01L 2200/0642; B01L 2200/0673; B01L 2300/0654; B01L 2300/0819; B01L 2300/0851; B01L 2300/0867; B01L 2300/087; B01L 2300/0877; B01L 2300/089; B01L 2300/1827; B01L 2400/0406; B01L 2400/0421; B01L 2400/0436; B01L 2400/0442; B01L 2400/086; B01L 2400/088; B01L 3/0241; B01L 3/5027; B01L 3/502707; B01L 3/502746; B01L 3/502753; B01L 3/502792; B01L 7/52; B01L 7/525; B01L 2400/0688; B01L 2400/0694; B01L 2400/082; B01L 2300/088; B01L 2200/0605; B01L 2200/0621; B01L 2200/0684; B01L 3/502738; B01L 2200/12; B01L 2200/10; B01L 2300/0883; B01L 2400/0448; B01L 2400/0454; B01L 2200/025; B01L 2300/0609; B01L 2300/0809; B01L 2300/0893; B01L 2300/12; B01L 2300/168; B01L 2400/065; B01L 3/5025; B01L 2300/0645; B01L 3/0268; B01L 2200/0652; B01L 2300/0829; B01L 2300/0636; B01L 2300/0681; B01L 2300/0803; B01L 2400/0439; B01L 2400/0478; B01L 2400/0481; B03C 2201/26; B03C 5/005; B03C 5/026; B03C 1/01; B03C 1/288; B03C 5/00; B03C 7/026; B03C 2201/18; G01N 33/54326; G01N 15/0612;
(Continued)

(56) References Cited

U.S. PATENT DOCUMENTS 8,034,628 B2 * 10/2011 Harrison ..... B01L 3/502707 422/503
RE43,122 E * 1/2012 Harrison ..... G01N 27/44704 204/451
(Continued)

FOREIGN PATENT DOCUMENTS

FR 2 958 186 A1 10/2011
JP 2007-075094 A 3/2007
JP 2008-116254 A 5/2008

OTHER PUBLICATIONS

Tice et al, "Formation of Droplets and Mixing in Multiphase Microfluidics at Low Values of the Reynolds and the Capillary Numbers", Aug. 12, 2003, Langmuir, vol. 19, pp. 9127-9133. (Year: 2003).*
(Continued)

*Primary Examiner* — Deborah K Ware
(74) *Attorney, Agent, or Firm* — Oliff PLC

(57) ABSTRACT

A method for handling, in a microfluidic system, microdrops which include samples, including the steps of forming, in an oil, microdrops of an aqueous solution containing a sample, the oil and/or the aqueous solution containing a sample including a gelling agent; trapping the microdrops by means of surface-tension traps pre-arranged in a trapping area; and at least partially gelling the oil in the trapping area and/or at least partially gelling the trapped microdrops.

24 Claims, 4 Drawing Sheets

(52) U.S. Cl.
CPC ..... *B01L 2200/0673* (2013.01); *B01L 2300/0816* (2013.01); *B01L 2300/0819* (2013.01); *B01L 2300/0851* (2013.01); *B01L 2400/086* (2013.01); *B01L 2400/088* (2013.01)

(58) Field of Classification Search
CPC ..... G01N 15/1459; G01N 15/1463; G01N 2015/1006; G01N 2015/149; G01N 2030/285; G01N 2030/565; G01N 27/27; G01N 27/44756; G01N 30/56; G01N 30/6095; G01N 35/08; G01N 1/40; G01N 1/405; G01N 2030/009; G01N 2035/1046; G01N 27/44704; G01N 27/44791; G01N 15/0272; G01N 15/1484; G01N 1/28; G01N 2015/0092; G01N 15/1404; G01N 2015/1409; G01N 35/085; G01N 21/78; G01N 33/54386; G01N 2035/1034; G01N 21/6428; G01N 2021/6439; G01N 21/6445; G01N 2500/00; G01N 33/5008; G01N 33/542; G01N 33/54333; G01N 33/573; G01N 33/582; C12M 33/00; C12M 47/04; C12N 13/00; C12N 9/2462; Y10T 436/25; Y10T 436/2575; Y10T 436/11; Y10T 436/25375; Y10T 436/255; Y10T 436/25625; Y10T 137/0324; Y10T 137/0391; Y10T 137/0396; Y10T 137/2082; Y10T 137/218; Y10T 117/10; Y10T 137/0318; Y10T 436/117497; Y10T 436/143333; Y10T 436/118339; Y10T 436/12; B01F 11/0071; B01F 13/0071; B01F 13/0076; B01F 13/0062; B01F 13/1022; B01F 3/0807; B01F 13/0083; B01F 5/0646; B01F 5/0647; B01F 2215/0037; B01F 3/0861; B01F 5/0403; B01F 13/0094; B01F 13/1013; B01F 3/0803; B01F 3/0865; B01F 5/0085; B01F 5/0471; B01F 5/0473; B01F 5/0653; F17D 1/12; B01J 13/08; B01J 19/0046; B01J 2219/00722; B01J 2219/0286; B01J 2219/00576; B01J 2219/00585; B01J 2219/00599; B01J 19/0093; B01J 2219/00725; B01J 2219/00736; B01J 2219/00756; B01J 2219/00783; B01J 2219/00837; B01J 2219/0086; B01J 2219/00869; B01J 2219/00889; B01J 2219/00891; B01J 2219/00975; B01J 2219/00977; B01J 14/00; B01J 2219/0059; B01J 2219/0074; B01J 2219/00894; B01J 2219/00903; B01J 2219/00867; B01J 19/00; B01J 2219/0034; B01J 2219/00351; B01J 2219/00418; B01J 2219/00466; B01J 2219/00468; B01J 2219/00479; B01J 2219/005; B01J 2219/00572; B01J 2219/00592; B01J 2219/00596; B01J 2219/0065; B01J 2219/00657; B01J 2219/00664; B01J 2219/00702; B01J 2219/0072; B01J 2219/00743; F16K 2099/0084; F16K 99/0017; F16K 99/0021; H01L 2924/0002; H01L 2924/00; B82Y 30/00; B01D 2009/0086; B01D 9/0072; C07K 14/43; C12Q 1/6806; C12Q 1/44; C12Q 1/025; C12Q 1/703; C12Q 1/6874; C12Q 2537/143; C12Q 2563/149; C12Q 2563/179; C12Q 2565/514; C12Q 1/25; C12Q 1/6804; C12Q 1/6818; C12Q 1/6827; C12Q 1/6869; C12Y 302/01017; C30B 29/54; C30B 29/58; C30B 7/14; C12P 19/34; Y02A 90/26; C40B 40/04; C40B 50/08; C40B 60/10
See application file for complete search history.

(56) References Cited

U.S. PATENT DOCUMENTS

| | | | | |
|---|---|---|---|---|
| 8,637,317 | B2 * | 1/2014 | Pamula | B01F 11/0071 422/502 |
| 9,050,606 | B2 * | 6/2015 | Pamula | G01N 33/54326 |
| 9,205,433 | B2 * | 12/2015 | Thwar | G01N 33/54326 |
| 9,358,551 | B2 * | 6/2016 | Thwar | G01N 33/54326 |
| 10,161,007 | B2 * | 12/2018 | Abate | B01L 3/502784 |
| 2003/0049320 | A1 | 3/2003 | Bhagwatwar et al. | |
| 2008/0241841 | A1 | 10/2008 | Murakawa et al. | |
| 2015/0125947 | A1 * | 5/2015 | Korczyk | B01L 3/502738 435/289.1 |
| 2015/0232942 | A1 * | 8/2015 | Abate | B01L 3/502784 506/9 |
| 2016/0177375 | A1 * | 6/2016 | Abate | B01L 3/502784 506/9 |
| 2016/0199853 | A1 * | 7/2016 | Harwood | C12M 33/00 435/6.12 |
| 2017/0121756 | A1 * | 5/2017 | Abate | C12Q 1/686 |
| 2017/0252744 | A1 * | 9/2017 | Baroud | B01L 3/502784 |
| 2018/0250686 | A2 * | 9/2018 | Chiu | C12M 33/00 |

OTHER PUBLICATIONS

Park et al, "Encoded Droplet Microcarrier for formation and isoaltion of drolet in a microfluidic device", 14th Intern'l Conf. on Mini. Systems for Chem and Life Sci., Oct. 3-7, 2010, Gronigen, The Netherlands. (Year: 2010).*

Tice et al, "Formation of Droplets and Mixing in Multiphase Microfluidics at Low Values of the Reynolds and the Capillary Numbers", pp. 9127-9133; ACS Aug. 12, 2003. (Year: 2003).*

Guo et al., "Droplet microfluidics for high-throughput biological assays," Lab on a Chip, 2012.

Joensson et al., "Droplet Microfluidics—a Tool for Single-Cell Analysis," Angewandte Chemie International Edition, 2012, pp. 12176-12192.

Yu et al., "Droplet-based microfluidic system for multicellular tumor spheroid formation and anticancer drug testing," Lab on a Chip, 2010, vol. 10, pp. 2424-2432.

Anna et al., "Formation of dispersions using 'flow focusing' in microchannels," Applied Physics Letters, Jan. 20, 2003, vol. 82, No. 3, pp. 364-366.

Thorsen et al., "Dynamic Pattern Formation in a Vesicle-Generating Microfluidic Device," Physical Review Letters, Apr. 30, 2001, vol. 86, No. 18, pp. 4163-4166.

Teh et al., "Droplet microfluidics," Lab on a Chip, 2008, vol. 8, pp. 198-220.

Jul. 14, 2015 International Search Report issued in the International Patent Application No. PCT/FR2014/052655.

Oct. 22, 2018 Office Action issued in Japanese Patent Application No. 2017-520412.

* cited by examiner

METHOD FOR HANDLING MICRODROPS WHICH INCLUDE SAMPLES

The present invention relates to a microfluidic method for handling samples, especially biological samples, in hydrogel microdroplets. The invention also relates to a device for carrying out such a method and to a product of samples obtained by carrying out such a method.

BACKGROUND

It is known from Guo, Rotem, Heyman, & Weitz, "Droplet microfluidics for high-throughput biological assays", Lab. Chip. 12 (2012), that droplets in microfluidic systems (or "microdroplets") may be used to contain chemical or biological reactions. In these systems, the content of these droplets may be assayed by observing the fluorescence of the droplet when it passes in front of a focused laser. However, these systems do not make it possible to observe the change over time of the content of these droplets without extracting them from the microfluidic device.

The study of individualized cells in microdroplets is also known, for example from Joensson, H. N. & Andersson Svahn, H., "Droplet microfluidics a tool for single-cell analysis", Angew. Chem. Int. Ed. Engl. 51, 12176-12192 (2012). Indeed, these microdroplets form well-defined compartments which make it possible to isolate biological samples such as cells, for example. This document especially teaches that the localization of the populations of encapsulated cells may be controlled by virtue of the accumulation of the droplets in culture chambers, in elongated channels, or else in static traps. This document also teaches that the cells may be encapsulated in functionalized hydrogels, surrounded by an oily phase.

However, the supply of nutrients or more generally of molecules of biological interest for the cells in such devices proves limited and the methods used (for example by electrofusion or picoinjection) prove complex. Consequently, these devices have numerous limits for the study of cell behavior, in particular in terms of time.

Moreover, from L. Yu, M. C. W. Chen and K. C. Cheung, "Droplet-based microfluidic system for multicellular tumor spheroid formation and anticancer drug testing", Lab Chip (2010), a method is known for handling hydrogel microdroplets containing multicellular spheroids. According to this method, hydrogel microbeads including cells are produced in a first microfluidic system. They are then recovered and washed in a bath, before being injected into a second microfluidic system comprising traps making it possible to fix the microdroplets.

Such a method is, however, complex, necessitating two separate microfluidic systems and three devices in total. In addition, it does not enable continuous observation of the samples. In particular, it does not make it possible to observe the initial moments between the formation of the droplets and the capture thereof.

SUMMARY

There is therefore a need for a method for handling microdroplets containing samples which is simpler and which nonetheless allows for a vast range of tests on the samples. There is also a need for a method for handling microdroplets which enables more effective sorting of the microdroplets.

To this end, the invention proposes a method for handling, in a microfluidic system, microdroplets including samples, comprising the steps consisting in:

i) forming, in an oil, microdroplets of an aqueous solution containing a sample, at least one of the oil and the aqueous solution comprising a gelling agent, ii) trapping the microdroplets by means of surface tension traps pre-arranged in a trapping zone, and iii) gelling at least one from at least a portion of the oil in the trapping zone and at least a portion of the trapped microdroplets.

Thus, according to the invention, in order to sort the microdroplets of interest, that is to say the microdroplets which contain samples of interest, these microdroplets are firstly trapped in surface tension traps (or capillary traps), then some of the microdroplets, and/or a portion of the oil which surrounds them, are gelled. The gelling of the microdroplets and/or of the oil which surrounds them facilitates sorting by enhancing the strength of trapping of the microdroplets in the traps. In other words, the gelling step makes it possible to prevent the microdroplets of interest being lost.

In addition, this gelling makes it possible to prevent the microdroplets from being able to fuse, which would cause mixing of the samples of these microdroplets.

Surface tension trap is intended to mean a trap a zone of the microfluidic system, the geometry of which, with the interfacial tension of the microdroplet, makes it possible to hold the microdroplet in place.

All the steps of the method are carried out in a single microfluidic system. Microfluidic system is intended to mean a system, the parts of which are manufactured according to microfabrication processes. Such a system has ducts, at least one dimension of which is typically less than a millimeter.

The shape of the microdroplet may be controlled. This control of the shape of the microdroplet may be combined with the control of the moment at which the microdroplet or a portion of the oil surrounding it is gelled, to enable various applications, especially in terms of cell manipulation.

Cells are intended to mean eukaryotic cells (for example plant, mushroom, yeast or mammalian cells), and prokaryotic cells (for example bacteria). For mammalian cells, a distinction is made between anchorage-independent cells (for example some cells of the blood cell line and highly transformed tumor cells) and anchorage-dependent cells (the majority of other cell types), some sub-types of which may become organized in spheroid form. Spheroids are intended to mean multicellular structures organized in the form of microtissues, the functionalities of which are similar to those of tissues derived from organs.

According to preferred embodiments, the method according to the invention comprises one or more of the following features, taken alone or in combination:

- step iii) consists in gelling at least a portion of the oil of the trapping zone, with the exception of the microdroplets;
- step iii) consists in gelling at least a portion of the microdroplets, with the exception of the oil surrounding the microdroplets in the trapping zone;
- the sample is one of one or more cells, especially a spheroid of cells, one or more beads trapping molecules, the beads especially being made of plastic, or one or more molecules;
- step iii) is carried out after sedimentation of the samples, especially of the cells, in the trapped microdroplets, in particular after formation of spheroids;

step iii) is carried out before sedimentation of the samples in the trapped microdroplets;

the method also comprises the step consisting in:

iv) replacing the oil surrounding the gelled microdroplets with an aqueous solution;

the aqueous solution replacing the oil contains a biochemical solution, the biochemical solution preferably comprising at least one of one or more pH or saline buffers, one or more nutrients, one or more growth factors, cytokines, one or more antibodies, one or more antigens, one or more molecules, especially of medicament, one or more cells, lipids, carbohydrates, especially in monomeric or polysaccharide form, amino acids and/or proteins;

the trapping zone is formed by a microfluidic chip comprising surface tension traps;

step i) consists in:

a) injecting, into a zone upstream of the trapping zone, an aqueous solution containing samples and a gelling agent where appropriate, b) injecting oil, containing a gelling agent where appropriate, into the zone upstream of the trapping zone in order to drive the aqueous solution containing samples towards an outlet of the trapping zone, the oil being injected so as to form microdroplets containing samples, then c) moving the microdroplets to the trapping zone and trapping the microdroplets in the trapping zone;

steps i) and ii) are carried out simultaneously in the trapping zone, by carrying out the actions consisting in:

filling the trapping zone with aqueous solution containing samples and a gelling agent where appropriate, then in injecting oil, containing a gelling agent where appropriate, into the trapping zone in order to drive the aqueous solution containing samples towards an outlet of the trapping zone, the surface tension traps being adapted to enable the breakage of the microdroplets containing samples at the surface tension traps;

step iii) consists in at least one of:

cooling or heating microdroplets and/or the oil, injecting a solution containing a chemical gelling agent, exposing the microdroplets and/or the oil to a light causing gelling, especially a UV light;

the oil contains a surfactant, the method preferably comprising a step of washing the surfactant before step iv);

the method comprises a step, prior to step i), of choosing the shape of the surface tension traps as a function of the desired shape of the microdroplets;

the trapping zone and the traps are chosen to:

form trapped microdroplets with a flat bottom, or form trapped microdroplets with a non-flat, especially curved, preferably convex, bottom;

the method comprises a step v) subsequent to step iii), and preferably subsequent to step iv), consisting in degelling at least some of the microdroplets gelled in step iii);

the method comprises a step vi), subsequent to step v), consisting in discharging the degelled microdroplets and/or the samples contained in these degelled microdroplets out from the trapping zone;

the method comprises a step of applying a stimulus to the samples contained in at least a portion of the trapped, gelled or ungelled, microdroplets; and the method comprises a step subsequent to step iii) consisting in driving the microdroplets around which the oil has not been gelled out from the trapping zone, in order to only retain in the trapping zone those microdroplets around which the oil has been gelled.

According to another aspect, the invention relates to a device for carrying out a method as described above, in all the combinations thereof, comprising:

means for forming microdroplets containing samples, a trapping zone, especially a microfluidic chip, for trapping the microdroplets at predetermined locations, and means for gelling at least a portion of the trapped microdroplets and/or of the oil.

The gelling means may comprise a device for injecting a chemical agent into the trapping zone.

The device may also comprise means for degelling at least some of the gelled hydrogel microdroplets and/or a portion of the gelled oil.

The invention also relates to a product of gelled microdroplets, comprising a zone for trapping microdroplets, in particular a microfluidic chip, and gelled microdroplets each including a sample and trapped in the trapping zone, the gelled microdroplets preferably being cryopreserved.

For this purpose, and with a view to the storage and/or distribution of this microdroplet product, the biochemical solution may contain cryoprotectants (DMSO, glycerol, trehalose, etc.) to enable the cryopreservation of the samples.

The gelled microdroplets may also be immersed in a fluid, preferably in an aqueous solution or in an oil, the fluid and the microdroplets preferably being cryopreserved.

The invention also relates to a product of microdroplets, comprising a trapping zone, especially a microfluidic chip, and microdroplets each including a sample and trapped in the trapping zone, the microdroplets being immersed in a gelled oil, the microdroplets and the gelled oil preferably being cryopreserved.

The samples may be mammalian cells, preferably cells from mammals with the exception of human cells, bacteria, yeasts or other cells used in bioprocesses, molecules, or beads trapping molecules at the surface.

BRIEF DESCRIPTION OF THE DRAWINGS

The invention will be better understood on reading the following description of exemplary embodiments of the invention in light of the appended drawings, in which.

DETAILED DESCRIPTION OF EMBODIMENTS

Figure 1:
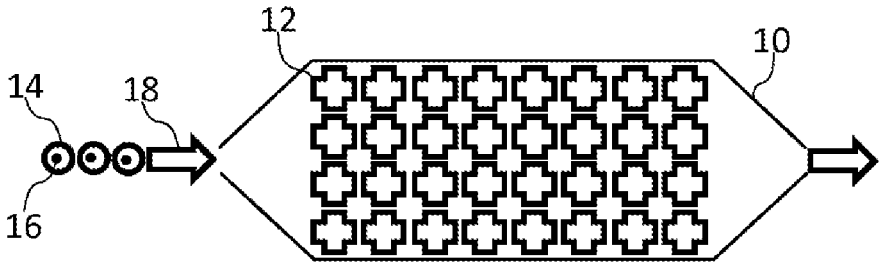
FIG. 1 schematically represents a microfluidic chip.

The invention relates to a method for handling hydrogel microdroplets including samples to be tested.

The following text will be more particularly concerned with samples in the form of cells, but other types of samples may of course be used.

The method essentially comprises three steps, all carried out in a single microfluidic system, the three steps consisting in:

- forming, in an oil, microdroplets of a liquid aqueous solution containing one or more cells, the oil and/or the aqueous solution comprising a gelling agent,
- trapping the liquid microdroplets by means of surface tension traps pre-arranged in a trapping zone, and
- gelling at least one of the oil and at least a portion of the trapped microdroplets.

The following text will be more particularly concerned with the case in which the aqueous solution is a hydrogel solution, the oil not comprising gelling agent, and in which the final step above consists in gelling at least a portion of the trapped microdroplets, without the oil itself being gelled. In this case, following the three steps mentioned above, the method may be continued by carrying out different steps, especially depending on the test which it is desired to carry out.

The method may especially be continued by a step consisting in replacing the oil around the gelled microdroplets with an aqueous solution, without moving the microdroplets from the surface tension traps. The aqueous solution may contain a biochemical solution with at least one of nutrients, growth factors, antibodies, medicament molecules and pH and/or saline buffers.

According to another aspect, the method makes it possible to control the three-dimensional shape of hydrogel beads in a microfluidic channel and/or in surface tension traps, with the primary application thereof being the encapsulation of cells in these microdroplets. Thus, depending on the shape of the microdroplets and the concentration of cells per microdroplet, the encapsulation of the cells in the hydrogel enables their culture or analysis, while infusing them with biochemical solutions, or applying physical stimuli to them, such as heat or light, for example.

Gel is intended to mean a medium composed predominantly of liquid and containing molecules or particles which may be organized to give it a solid appearance, such as, for example, the absence of flow in its stable state. This solution may be handled in the liquid state and may then be "gelled" by chemical or physical means. In some cases, the gelling may be reversible. When the liquid is water, reference is made to a hydrogel.

As indicated above, the proposed microfluidic method comprises a first step of formation of hydrogel microdroplets containing biological cells in an oil.

In this case, the microdroplets (or microbeads) have a diameter of the order of a micrometer, especially a diameter of between 10 and 1000 micrometers.

The hydrogel is for example an aqueous solution comprising a gelling agent. The gelling agent is chosen by the user as a function of the application. An example of gelling agent which may be physically gelled is agarose, which is liquid at room temperature and which gels at low temperature. A gelling agent which may be chemically gelled is for example alginate, which is liquid in solution and which gels when calcium ions $Ca^{2+}$ are supplied.

On a biological level, the biochemical and biomechanical properties of the hydrogel may make it possible for anchorage-sensitive cells to establish specific interactions with the matrix thus formed. These interactions are essential for the survival of anchorage-dependent mammalian cells and play a role in the regulation of their phenotype. The nature of the matrix may for example make it possible to observe cellular migration or proteolysis (digestion of the matrix by the cells). Particularly conclusive experiments were carried out with agarose, alginate and PEG-DA (polyethylene glycol diacrylate) but also with gelatin, type I collagen or Matrigel®. For example, hydrogels containing various proteins, glycoaminoglycans and other components of the extracellular matrix (for example type I collagen, gelatin or Matrigel®) demonstrated their ability to maintain viability, to support proliferation and the ability to migrate, and also to maintain the phenotype of certain populations of anchorage-dependent cells. It should be noted that the gels can be combined, by supplying successive microdroplets for example. Each of the hydrogels mentioned has a specific corresponding gelling procedure. Some hydrogels, such as PEG-DA, may also be functionalized to enable the survival and/or development of the cells, by incorporating peptidomimetics (for example hydrogels may be functionalized with RGD-type consensus sequences with which some types of mammalian cells can establish specific interactions, or else PRCG[V/N]PD or HEXGHXXGXXH consensus sequences specific to metalloproteases) or the sensor of specific molecules via the incorporation of antibodies or aptamers, for example the in situ capture of cytokines secreted by encapsulated lymphocytes. The mechanical properties of these hydrogels may also be altered for different applications, by varying for example their degree of crosslinking and/or their concentration. All of these physicochemical properties may be different from one trap to another within the trapping zone. Setting up a rigidity gradient within the trapped hydrogel microdroplets enables, for example, the controlled differentiation of stem cells into different cell types. Finally, several hydrogels may coexist within the same microdroplet following mixing or the successive formation of several layers around the gelled core in the trap.

The cells are mixed with the hydrogel, a priori before the formation of the microdroplets. However, the hydrogel and the cells may be mixed directly in the microfluidic device, before the formation of the microdroplets.

Numerous methods have already been proposed to form such microdroplets in a mobile phase such as oil. For example, mention may be made of the following examples of methods:

- the method referred to as "flow-focusing", described for example in S. L. Anna, N. Bontoux and H. A. Stone, "Formation of dispersions using 'Flow-Focusing' in microchannels", Appl. Phys. Lett. 82, 364 (2003), the content of which is incorporated herein by reference,
- The "T-junction" method, described for example in "Dynamic pattern formation in a vesicle-generating microfluidic device" by T. Thorsen, R. W. Roberts, F. H. Arnold et S. R. Quake, Phys. Rev. Lett. 86, 4163-4166 (2001), the content of which is incorporated herein by reference, or else
- the "confinement gradient" method described for example in the application FR-A-2 958 186, the content of which is incorporated herein by reference.

These methods make it possible to form microdroplets with substantially equal dimensions.

After formation of these microdroplets, the microdroplets are conveyed from the zone in which they were formed to the trapping zone by microchannels, carried by a flow of oil and/or by slopes or rails. It has been observed that this conveying aids the formation of spheroids in the microdroplets. The microdroplets are then trapped by surface tension traps arranged in the trapping zone, especially in a microfluidic chip. The trapping zone (or the microfluidic chip 10) is treated by a hydrophobic surface treatment, and filled with an oil containing a surfactant. The use of surfactant enables the stabilization of the microdroplets and the reproducibility of their formation. The surfactants also make it possible to prevent the coalescence of the microdroplets in the event of contact during their conveying from the production device to the traps of the trapping zone.

The microfluidic chip 10, as illustrated in FIG. 1, is composed of a culture chamber, possibly several centimeters square, containing numerous surface tension traps organized in a table or matrix. The surface tension traps 12 may have various shapes. For example, in the case of cylindrical traps, their diameter may go from a few tens of microns to several hundred depending on the desired application. For the encapsulation of single cells or cells individualized in the microdroplets, the diameter of the traps may be for example 50 microns, which corresponds to a density of approximately 5000 traps per centimeter square. For the study of large cellular aggregates or spheroids, this diameter may go up to 250 microns, which then corresponds to a trap density of the order of 250 traps per centimeter square.

As illustrated in FIG. 1, the microdroplets 14 including the biological cells 16, formed outside the microfluidic chip 10, are carried into the latter, for example by means of a flow of oil illustrated by the arrow 18, such that some of these microdroplets are trapped in the surface tension traps 12.

However, as a variant, it is proposed here to form hydrogel microdroplets containing biological cells in an oil without precise control of the flow of hydrogel containing the biological cells in the oil. This is because only those microdroplets having suitable dimensions are subsequently trapped in the trapping zone, such that the latter is occupied by microdroplets which actually have a great homogeneity of dimension, of shape, and of concentration of biological cells.

Figure 2:
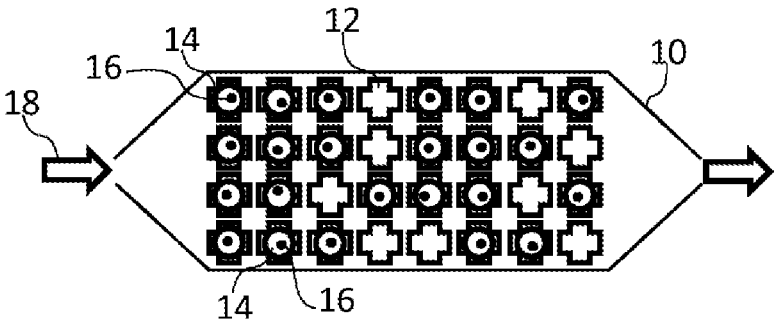
FIG. 2 schematically represents the microfluidic chip from FIG. 1, in which some traps are occupied by a hydrogel microdroplet containing samples, FIG. 3 schematically represents the microfluidic chip from FIG. 1 containing a mixture of hydrogel and samples to be tested, FIGS. 4 to 6 schematically illustrate a means for discharging a portion of the samples contained in hydrogel microdroplets trapped in a microfluidic chip out from this microfluidic chip, FIGS. 7 to 12 schematically illustrate examples of surface tension trap geometries and the shapes of microdroplets which they make it possible to obtain, and FIGS. 13 to 15 schematically illustrate examples of sedimentation of samples in hydrogel microdroplets.
Figure 3:
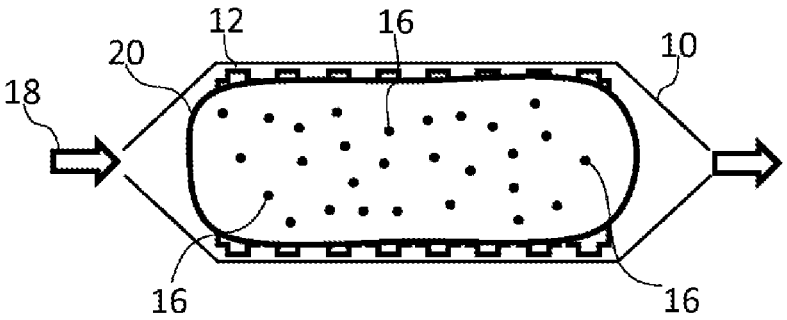

According to another variant illustrated in FIG. 3, the trapping zone, especially a microfluidic chip 10, contains a solution of hydrogel 20 containing biological cells 16. Oil is then injected into the trapping zone (the injection is schematically represented by the arrow 18) which drives the hydrogel solution 20 containing biological cells 16 towards an outlet from the trapping zone. The microdroplets then form directly in the surface tension traps 12, by trapping hydrogel in these traps of the microfluidic chip until a configuration substantially identical to that illustrated in FIG. 2 is obtained. The microdroplets thus form by spontaneous division (or breakage) of the hydrogel solution containing the biological cells on the surface tension traps. In this case also, precise control of flows is not necessary and it is even possible to push the syringes by hand without having to use sophisticated instruments. In this case, deep surface tension traps are preferred, to enable the breakage of the microdroplets (that is to say their formation) at the surface tension traps. Such traps will be described subsequently.

It should be noted here that the traps may be of very different shapes, especially as a function of the desired application, that is to say in particular as a function of the desired shape of the trapped microdroplets. The cavity forming a trap may also be located, without preference, on the upper wall, lower wall, or one of the side walls of the trapping zone, especially of the microfluidic chip.

FIGS. 7 to 12 illustrate shapes which may be envisaged for the surface tension traps 12 of the microfluidic chip 10, and the shape of the microdroplets 14 which may be obtained by means of these surface tension traps 12.

Figure 7:
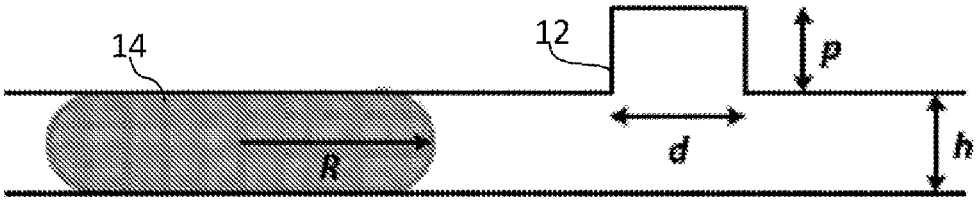

In particular, the shape of the trap 12 makes it possible to control the shape of the trapped microdroplets, according to the geometric parameters of the microfluidic channel in which the trap 12 is formed, and the volume of the trapped microdroplets. FIG. 7 schematically illustrates the parameters to be taken into account to determine the profile of the microdroplet, namely the radius R of the microdroplet confined in a channel containing a trap 12, the height h of this channel, which is less than the radius R of the microdroplet in the channel, and the diameter d and the depth p of the trap 12.

Figure 8:
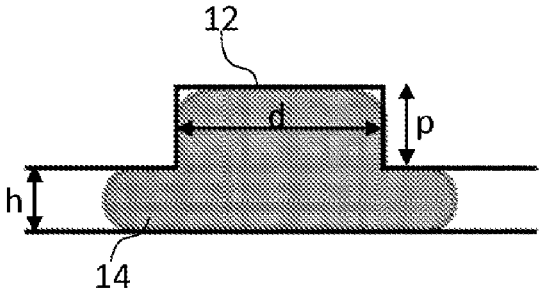
Figure 9:
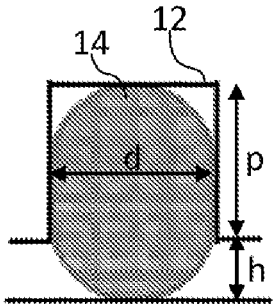
Figure 10:
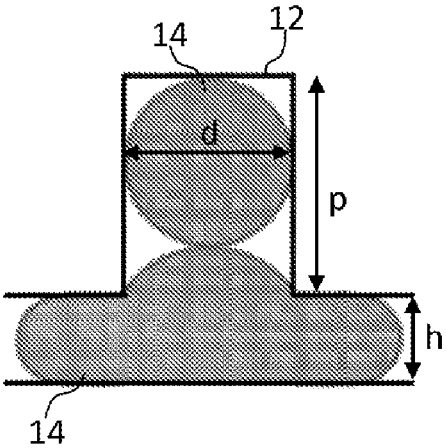

When the trap 12 is cylindrical and has a diameter d greater than twice the height h of the channel, as illustrated in FIGS. 8 to 10, then the microdroplet 14 fits as much as possible into the trap 12. Depending on the relative volumes of the trap 12 and of the microdroplet 14, the microdroplet 14 may or may not have a hemispherical dome, and may or may not have a flat portion, confined by the walls of the channel. Thus, in FIG. 8, the volume of the microdroplet 14 is greater than the volume of the trap 12. In this case, the microdroplet 14 virtually entirely fills the trap 12 and has a shape which is flattened against the walls of the channel and of the trap. In FIG. 9, the microdroplet 14 has a volume which is slightly smaller than that of the trap 12, so the microdroplet 14 has two hemispherical domes and only lightly touches the walls of the channel. Finally, if the microdroplet 14 has a volume which is significantly smaller than the volume of the trap 12, as is illustrated in FIG. 10, then the microdroplet 14 (or even several microdroplets 14) are entirely accommodated within the trap 12.

Figure 11:
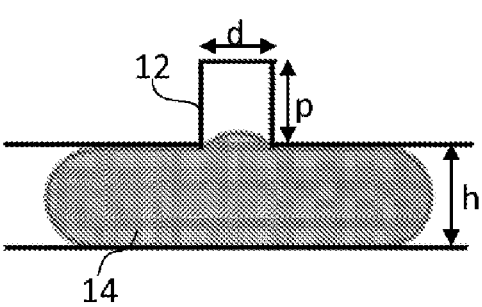

In the case of FIG. 11, on the other hand, the trap has a diameter d less than half the height h of the channel. Consequently, the microdroplet 14 remains essentially confined in the channel and only has a small hemispherical dome in the trap 12.

Figure 12:
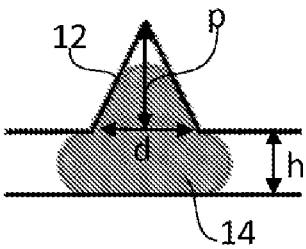

Finally, in the case of FIG. 12, the trap 12 is conical and has a diameter d twice as large as the height h of the channel. The microdroplet 14 thus fits snugly in the shape of the wall of the trap 12 in order to form a hemispherical dome in the trap 12

Figure 13:
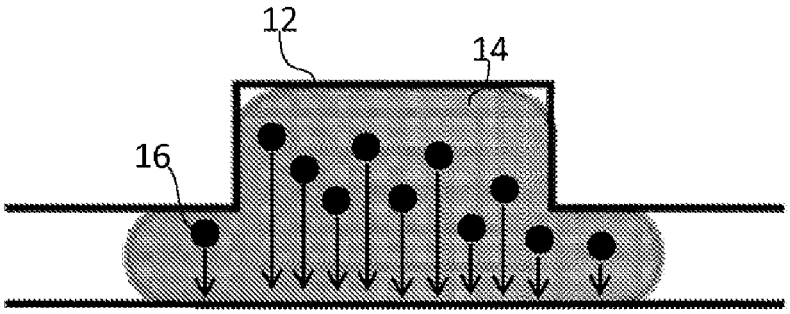
Figure 14:
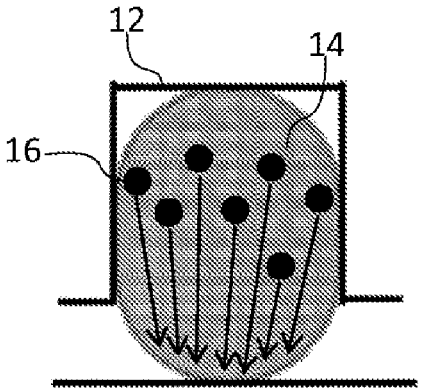
Figure 15:
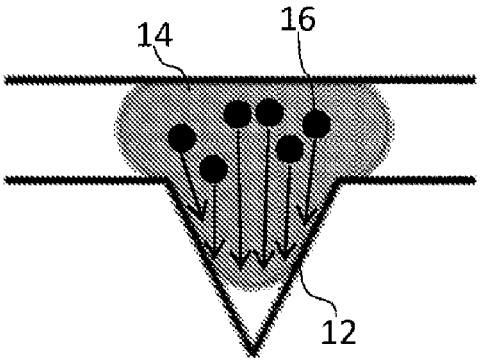

Moreover, as illustrated in FIG. 13, if the microdroplet 14 trapped in a trap 12 has a flat bottom, the cells 16 sediment and deposit themselves statistically uniformly at the bottom of the microdroplet 14. The cells may then be observed individually and do not aggregate. On the other hand, if the microdroplet 14 trapped in a trap 12 has a non-flat bottom, especially convex, as illustrated in FIGS. 14 and 15, then the cells 16 come into contact with the interface of the microdroplet 12 during their sedimentation and have to slide along this interface. The cells 16 thus concentrate at the bottom of the microdroplet 14, and may optionally aggregate and form spheroids in the case of some anchorage-dependent cells.

The microfluidic method proposed here comprises a step of gelling of the microdroplets following the trapping of these microdroplets.

This step may be carried out in various ways, especially as a function of the hydrogel gelling agent used. Thus, according to a first example, the hydrogel contains, preferably is, agarose. The microdroplets are then gelled by cooling the microfluidic chip. When the hydrogel contains, or preferably is, alginate, it is possible to provide calcium ions $Ca^{2+}$ in the oil in which the microdroplets are immersed, or indeed to premix calcareous particles with the alginate and to saturate the oil in which the microdroplets are immersed in $CO_2$. The alginate is thus acidified and calcium ions are released. Of course, since other gelling agents may be used, other gelling means may be used.

Moreover, as a function of the application sought, this gelling step may be carried out at different moments during the handling method. In particular, gelling may be carried out immediately after trapping so as to fix the cells in place in the microdroplet, and to prevent them from sedimenting. It is then possible to observe the cells independently of one another. Alternatively, gelling is carried out after the sedimentation of the cells to form spheroids. This makes it possible to observe the behavior of cells which have formed a spheroid. According to another alternative, the microdroplets are only gelled after operations for handling the cells in liquid medium, for example to selectively extract certain cells—those in non-gelled microdroplets. This may be useful for cells such as bacteria or erythrocytes and leucocytes, which are anchorage-independent.

After gelling, it is possible to replace the oil in which the microdroplets are immersed with an aqueous solution containing especially a biochemical solution comprising biochemical components such as nutrients, growth factors, antibodies, drugs or medicament molecules, for example. These biochemical components diffuse through the gel and reach the cells. It is thus possible to study the reaction of the cells, which are independent or in the form of spheroids, to these stimuli. The hydrogel thus makes it possible to keep the cells in a precise location while allowing their infusion by an aqueous phase and having compartmentalized the biological sample beforehand during the encapsulation of the cells in microdroplets.

In order to successfully carry out this operation, it is preferable to force the surfactant out from the interfaces of the microdroplets. This is because the shell that the surfactants form at the interface of the microdroplets may be so effective that it prevents the aqueous phase, which is injected to replace oil, from filling the microfluidic chip, keeping the microdroplets gelled in their respective traps. Since coalescence is combated by the presence of surfactant, the arrival of the interface of the aqueous phase at a trap results in a force applied to the gelled microdroplet, which may be forced out of the trap if the hydrogel which composes it is sufficiently compressible. This is why it is preferable to promote coalescence by reducing the concentration of surfactant at the interface. For this purpose, the microfluidic chip is infused, before injection of the aqueous phase, with oil which, unlike the oil used previously, does not contain surfactant. The concentration of surfactant in the oil of the microfluidic chip decreases, which makes it possible to shift the equilibrium from surfactant adsorption at the interface towards desorption. For high concentrations of surfactant, for example of the order of a few percent by weight, it is preferable to infuse the microfluidic chip with an amount of oil equivalent to 50 times the volume of the microfluidic chip. This ratio depends on the nature of the surfactant(s) and on its/their affinity for the two phases.

The shape of the traps may also be optimized to ensure the gelled microdroplets are held in position in the traps. Thus, in the case of a sufficiently deep cylindrical trap, if the height of the channel is larger than the radius of the trap, the entry of the microdroplet into the trap will be minimal, resulting in a low trapping efficiency. Subsequently, there is a limit on the velocity of the outer flow beyond which the microdroplets are forced out of the traps. Conversely, when the height of the channel is smaller than the radius of the trap, the microdroplet, as long as it is large enough, penetrates significantly into the cavity of the trap, resulting in a high trapping efficiency. The microdroplets remain in place regardless of the velocity of the outer flow. In the first case, the shape of the microdroplet is very close to its shape in the channel, whereas in the second case, it assumes locally the shape of the trap.

Figure 4:
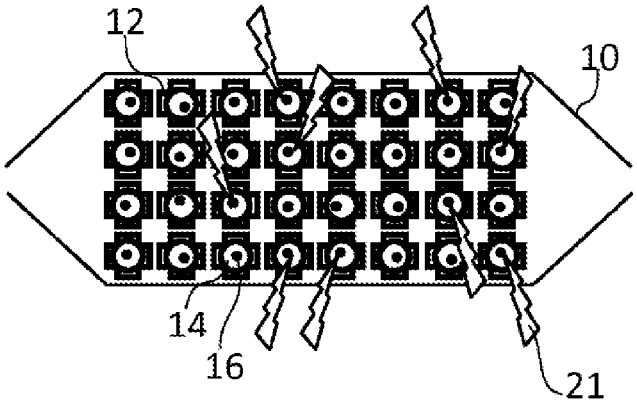
Figure 5:
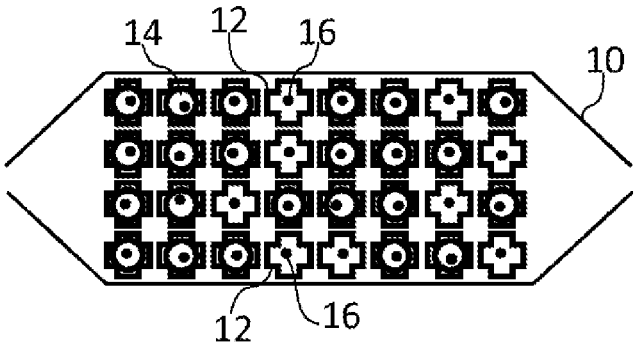
Figure 6:
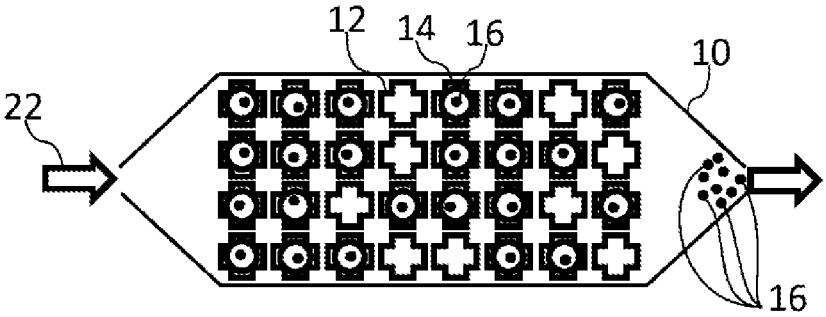

When the gelling agent of the hydrogel chosen is reversible, it is possible to de-gel the microdroplets then to discharge their contents from the microfluidic chip, as illustrated in FIGS. 4 to 6. In the case of these FIGS. 4 to 6, the microdroplets 14 are gelled microdroplets of agarose, for example. These microdroplets 14 of agarose are degelled one by one by locally heating them (heating being illustrated by the lightning bolts 21), especially by means of an infrared laser or electrodes. The heat liquefies the agarose. When the phase surrounding the microdroplets 14 is aqueous, the content 16 of the degelled agarose mixes with the aqueous phase. It is then possible to carry this content using the flow 22 of the aqueous phase, optionally in order to recover it. It is also possible thereby to eliminate the cells deemed to be uninteresting by the microfluidic chip 10. Once again, the shape and size of the trap are preferably chosen to enable the extraction of the cells. For example, in the case in which the cells must remain viable, the dimensions of the trap are sufficiently large for the heating of the hydrogel not to induce cell death mechanisms not to induce cell death mechanisms.

Alternatively, when the phase surrounding the microdroplets is oily, a flow of oil may be applied to dislodge the liquid microdroplet from the trap. In this case, the shape and the strength of the trap are preferably of such dimensions as to allow only the extraction of the microdroplet chosen, and no others. This dimensioning depends especially on the value of the surface tension between the aqueous phase and the oil, and also on the rigidity of the gel microdroplets and their shape within the trap.

Another alternative is to keep the microdroplets liquid, for the handling of cells in suspension, for example bacteria. Gelling is then only carried out for the selective extraction of microdroplets. In this case, it is possible either to gel all the microdroplets before extraction and to apply the protocol described above, or on the other hand to gel only those microdroplets that it is desired to keep in the traps.

By virtue of slight modifications, the process presented enables very varied biological applications to be examined. In each case, the device may of course also be modified by adjusting the height of the channel in the microfluidic chip, and the geometry of the traps.

Thus, for example, rapid gelling with a low concentration of cells makes it possible to individualize a few single cells in each microdroplet, while trying to limit their direct interactions. These cells may for example be bacteria, yeasts or mammalian cells.

Alternatively, a high concentration of cells, still with rapid gelling, makes it possible to obtain a large number of cells which are still individualized but which are close to one another. It is then possible for example to examine interactions between cells, possibly in co-culture, via paracrine secretions.

The cells may however be kept encapsulated for a long time in the liquid phase before gelling. A low concentration of cells then makes it possible, for example, to study anchorage-independent cells, such as lymphocytes, in suspension. A high concentration of cells and a shape of the trapped microdroplets enabling sedimentation of the cells makes it possible to bring together the cells which will be able to reorganize themselves into spheroids.

The method may also make it possible to form spheroids directly in the chip in a controlled manner. The volume of the microdroplets created may be controlled by the device for forming microdroplets upstream of the microfluidic chip. This volume is preferably regulated such that the microdroplets, once trapped, have a diameter equal to that of the trap, and a spherical shape. For this purpose, the depth of the trap is preferably at least equal to its diameter. The fact that the diameter of the trapped microdroplet coincides with that of the trap makes it possible to ensure a high trapping efficiency. The spherical shape promotes the formation of spheroids. For this particular application, the microdroplets preferably contain cells in suspension in an aqueous phase comprising or consisting of culture medium and hydrogel. Once the traps are filled with such a microdroplet, the external flow of oil is stopped, which stops recirculations within the microdroplets and promotes sedimentation of the cells. The spherical shape of the microdroplets in the traps then induces a concentration of the cells at their lowest points, until they come into contact. Then, resting the chip under conditions favorable for the survival and proper metabolic functioning of the cells, especially in terms of temperature, for a duration ranging from several hours to several days, enables the reorganization of the cells concentrated at the bottom of the trapped microdroplet, into a spheroid.

The duration necessary for spheroid formation may especially depend on the cell type used and on the composition of the hydrogel. For H4IIEC3 rat hepatocytes in a solution of agarose at 1% by weight, diluted in culture medium, it has been observed that this duration is less than 24 hours. Of course, the hydrogel is kept liquid during the period of spheroid formation.

This method makes it possible to rapidly form a large number of spheroids of very homogeneous sizes. Indeed, the size of the spheroids is given by the number of cells encapsulated in each microdroplet and hence by the concentration of the solution of cells injected into the microfluidic chip. The distribution of the number of cells per microdroplet, and hence that of the size of the spheroids formed, is very homogeneous as long as the cells are sufficiently individualized at the time of injection. In experiments conducted by the inventors, a mean of 98% of the traps were filled with one microdroplet of liquid agarose which contained a well reorganized spheroid after 24 hours of incubation.

The spheroids obtained in the microfluidic chip may be kept in culture for several days. For example, spheroids of H4IIEC3 cells encapsulated in agarose may be cultured in the chip for a week without significantly altering their viability and while conserving high functionality (in this example, strong and continuous albumin secretion).

The method presented here and the microfluidic chip obtained by carrying it out constitute an excellent tool for screening medicaments. It is possible, for example, to create spheroids of cancer cells and observe if their viability decreases over time as a function of exposure to a tested molecule. By adding, to the chip, a device which makes it possible to set up a concentration gradient within the chamber, or else by setting up parallel chips, it is possible to test a whole range of concentrations in the same system. The high efficiency of the method for formation of these spheroids also makes it possible to create a large number thereof starting from very limited samples. 500 spheroids approximately 70 μm in diameter may thus be formed with only 100 000 cells. The cells which compose the spheroids may also be of different types in order to approach themes of co-culture. These cell types may be mixed homogeneously in solution before injection into the chip or be arranged according to a certain structural organization, in several successive hydrogel layers or simply by adhesion to the hydrogel after having been infused in the external aqueous phase. For example, it is possible to associate fibroblasts and epithelial cells to form a skin model and test the toxicity of cosmetic products, neurons and astrocytes to model the brain, or else endothelial cells and smooth muscle cells as in blood vessel walls.

Since the method presented here makes it possible to achieve a very advanced degree of control of the microenvironment of the cells in culture, it is also an excellent tool for studying stem cell differentiation. Indeed, the encapsulated cells may be subjected to a full range of concentrations of differentiation factors and, potentially at the same time, a full range of rigidities of the matrix, while adjusting for example the hydrogel concentration. Similarly, the method may be used to observe embryo development over time, interacting with physicochemical factors from the external medium.

In the case of primary cells, originating from a patient, this method makes it possible to carry out medical diagnostics based on the response of the cells to certain markers. In this case, the cells are captured with a very low degree of loss. It is then possible to subject the cells to known tests for diagnosing certain diseases, such as characterization of a cancer biopsy. For example, it is possible to test for the presence of a mutation in the genome of the encapsulated cells, for example by polymerase chain reaction (PCR) in situ or by the FISH method. It is also possible to detect the expression of specific proteins by labeling methods, for example by supplying antibodies for immunolabeling or for an in situ immuno-enzymatic method, ELISA (enzyme-linked immunosorbent assay).

The method described above offers the possibility of carrying out all the steps of cell analysis and culture in a microfluidic chip, by virtue of the gelling of the microdroplets following their trapping in the chip. This makes it possible to use much smaller amounts of reagents than for tests carried out in multi-well plates or culture dishes. This also makes it possible to monitor the cell responses over time, following different stimuli.

The method described above may be easily carried out in a device comprising:

- means for forming hydrogel microdroplets containing cells,
- a trapping zone, especially a microfluidic chip, for trapping the hydrogel microdroplets at predetermined locations, and
- means for gelling at least a portion of the trapped microdroplets.

The gelling means comprise, for example, a device for injecting a chemical agent into the trapping zone, and/or means for temperature regulation, for example to cool the microfluidic chip.

The device may also comprise means for degelling at least some of the gelled hydrogel microdroplets, for example a laser.

The method described above also makes it possible to produce a product of gelled microdroplets, comprising a zone for trapping microdroplets, in particular a microfluidic chip, and gelled microdroplets each including one or more cells trapped in the trapping zone, the gelled microdroplets preferably being cryopreserved. The cells may be aggregated in the form of clusters or spheroids. The gelled microdroplets may be immersed in a fluid, preferably in an aqueous solution or in an oil, the fluid and the microdroplets preferably being cryopreserved. This cryopreservation makes it possible especially to keep the cells under stable conditions for a long period, with a view to transporting or storing them for subsequent analysis.

The biological cells encapsulated in the microdroplets may be bacteria, yeasts, eukaryotic cells, mammalian cells, preferably mammalian cells with the exception of human cells, more preferably still rat cells or cells from other mammals, or human cells isolated from their natural environment.

Of course, the invention is not limited to just the examples described above but rather is open to numerous variants accessible to those skilled in the art, within the context of the appended set of claims.

In particular, the samples used, aside from cells, may especially also be molecules or plastic beads functionalized by coupling them to molecules.

Moreover, the trapped microdroplets may be fused with other microdroplets supplied by the flow of aqueous solution.

The aqueous solution which constitutes the microdroplets may also contain a biochemical solution, the biochemical solution preferably comprising at least one of lipids (fatty acids, etc.), carbohydrates (in monomeric or polysaccharide form, etc.), amino acids and proteins (growth factors, cytokines, antibodies, antigens, etc.), and also saline and/or pH buffers.

Finally, according to one variant, the oil (or oily phase) surrounding the microdroplets may contain fluoro oils (FC40 type) or else photo-crosslinkable, water-immiscible solutions (Norland Optical Adhesive type) which, once polymerized, make it possible to gel the oil and thereby to physically and selectively isolate the microdroplets. It is thus possible to more robustly compartmentalize the microdroplets relative to one another. This makes it possible to prevent two microdroplets from fusing, causing mixing of the samples which they contain. This also makes it possible to durably store the samples, with the risks of evaporation of the microdroplets especially being greatly reduced due to the compartmentalization of the microdroplets by the gelled oil, which forms a solid compartment around the microdroplets.

Once a portion of the oil has been gelled, it is possible to drive the microdroplets around which the oil has not gelled out from the trapping zone. For this purpose, it is possible to use a flow of oil or another fluid in the trapping zone, the flow being sufficiently strong to carry the microdroplets. It is thus possible to retain only those microdroplets around which the oil has gelled in the trapping zone.

It should be noted here that microdroplets may be gelled even in the case in which the oil is gelled. In addition, the method may of course comprise, in this case in which a portion of the oil is gelled, a subsequent step of degelling the gelled oil.

The invention claimed is:

1. A method for handling, in a microfluidic system, microdroplets including samples, comprising:

i) forming, in an oil, microdroplets of an aqueous solution containing a sample, the aqueous solution containing a sample comprising a gelling agent, ii) trapping the microdroplets by means of surface tension traps pre-arranged in a trapping zone, and iii) gelling at least a portion of the trapped microdroplets, wherein all steps of the method are carried out in a single microfluidic system.

2. The method as claimed in claim 1, in which the sample is one of one or more cells, one or more beads trapping molecules, or one or more molecules.

3. The method as claimed in claim 1, in which the step iii) is carried out after sedimentation of the samples in the trapped microdroplets.

4. The method as claimed in claim 1, in which the step iii) is carried out before sedimentation of the samples in the trapped microdroplets.

5. The method as claimed in claim 1, also comprising:

iv) replacing the oil surrounding the gelled microdroplets with an aqueous solution.

6. The method as claimed in claim 5, in which the aqueous solution replacing the oil contains a biochemical solution, one or more nutrients, one or more growth factors, cytokines, one or more antibodies, one or more antigens, one or more molecules, one or more cells, lipids, carbohydrates, amino acids and/or proteins.

7. The method as claimed in claim 1, in which the trapping zone is formed by a microfluidic chip comprising the surface tension traps.

8. The method as claimed in claim 1, in which the step i) comprises:

a) injecting, into a zone upstream of the trapping zone, an aqueous solution containing samples and a gelling agent where appropriate, b) injecting oil, containing a gelling agent where appropriate, into the zone upstream of the trapping zone in order to drive the aqueous solution containing samples towards an outlet of the trapping zone, the oil being injected so as to form microdroplets containing samples, then c) moving the microdroplets to the trapping zone and trapping the microdroplets in the trapping zone.

9. The method as claimed in claim 1, in which the steps i) and ii) are carried out simultaneously in the trapping zone, by carrying out the actions comprising:

filling the trapping zone with aqueous solution containing samples and a gelling agent, then injecting oil into the trapping zone in order to drive the aqueous solution containing samples towards an outlet of the trapping zone, the surface tension traps being adapted to enable the breakage of the microdroplets containing samples at the surface tension traps.

10. The method as claimed in claim 1, in which the step iii) comprises at least one of:

cooling or heating microdroplets and/or the oil, injecting a solution containing a chemical gelling agent into the trapping zone, exposing the microdroplets and/or the oil to a light causing gelling.

11. The method as claimed in claim 1, in which the oil contains a surfactant, the method comprising a step of washing the surfactant after step iii).

12. The method as claimed in claim 1, comprising a step, prior to step i), of choosing the shape of the surface tension traps as a function of the desired shape of the microdroplets.

13. The method as claimed in claim 12, in which the trapping zone and the traps are chosen to:

form trapped microdroplets with a flat bottom, or form trapped microdroplets with a non-flat bottom.

14. The method as claimed in claim 1, comprising a step v) subsequent to step iii), comprising degelling at least some of the microdroplets gelled in step iii).

15. The method as claimed in claim 14, comprising a step vi), subsequent to step v), comprising discharging the degelled microdroplets and/or the samples contained in these degelled microdroplets out from the trapping zone.

16. The method as claimed in claim 1, comprising a step of applying a stimulus to the samples contained in at least a portion of the trapped, gelled or ungelled, microdroplets.

17. The method as claimed in claim 1, comprising a step subsequent to step iii) comprising driving the microdroplets around which the oil has not been gelled out from the trapping zone.

18. A device for carrying out a method as claimed in claim 1, comprising:

means for forming microdroplets containing samples, a trapping zone for trapping the microdroplets at predetermined locations, and means for gelling at least a portion of the trapped microdroplets.

19. The device as claimed in claim 18, in which the gelling means comprise a device for injecting a chemical agent into the trapping zone.

20. The device as claimed in claim 19, also comprising means for degelling at least some of the gelled hydrogel microdroplets.

21. A method for handling, in a microfluidic system, microdroplets including samples, comprising:

i) forming, in an oil, microdroplets of an aqueous solution containing a sample, the oil comprising a gelling agent, ii) trapping the microdroplets by means of surface tension traps pre-arranged in a trapping zone, and iii) gelling at least a part of the oil in the trapping zone, wherein all steps of the method are carried out in a single microfluidic system.

22. The method as claimed in claim 21, in which the steps i) and ii) are carried out simultaneously in the trapping zone, by carrying out the actions comprising:

filling the trapping zone with aqueous solution containing samples, then injecting oil containing a gelling agent into the trapping zone in order to drive the aqueous solution containing samples towards an outlet of the trapping zone, the surface tension traps being adapted to enable the breakage of the microdroplets containing samples at the surface tension traps.

23. A device for carrying out a method as claimed in claim 21, comprising:

means for forming microdroplets containing samples, a trapping zone for trapping the microdroplets at predetermined locations, and means for gelling at least a portion of the oil.

24. The device as claimed in claim 23, also comprising means for degelling at least a portion of the gelled oil.

* * * * *